US006196798B1

(12) United States Patent
Fukuno et al.

(10) Patent No.: US 6,196,798 B1
(45) Date of Patent: Mar. 6, 2001

(54) GAS TURBINE COOLING BLADE

(75) Inventors: Hiroki Fukuno; Yasuoki Tomita; Shigeyuki Maeda; Yukihiro Hashimoto; Kiyoshi Suenaga, all of Hyogo-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/242,330

(22) PCT Filed: Jun. 12, 1998

(86) PCT No.: PCT/JP98/02594

§ 371 Date: Feb. 11, 1999

§ 102(e) Date: Feb. 11, 1999

(87) PCT Pub. No.: WO98/57041

PCT Pub. Date: Dec. 17, 1998

(30) Foreign Application Priority Data

Jun. 12, 1997 (JP) ..... 9-155124

(51) Int. Cl.[7] ..... F01D 5/18

(52) U.S. Cl. ..... 416/97 R; 415/115

(58) Field of Search ..... 415/114, 115, 415/116; 416/96 A, 96 R, 97 A, 97 R

(56) References Cited

U.S. PATENT DOCUMENTS

| | | | | |
|---|---|---|---|---|
| 5,577,889 | | 11/1996 | Terazaki et al. . | |
| 5,813,835 | * | 9/1998 | Corsmeier et al. | 416/97 R |
| 5,997,251 | * | 12/1999 | Lee | 416/97 R |

FOREIGN PATENT DOCUMENTS

| | | |
|---|---|---|
| 57-309 | 1/1982 | (JP) . |
| 61-155601 | 7/1986 | (JP) . |
| 51-77710 | 3/1996 | (JP) . |

* cited by examiner

*Primary Examiner*—Edward K. Look
*Assistant Examiner*—Liam McDowell
(74) *Attorney, Agent, or Firm*—Sughrue, Mion, Zinn, Macpeak & Seas, PLLC

(57) ABSTRACT

A number of air-transpiration holes (4) are provided at a leading edge portion (2) of a cooled blade (1). Cooling air flowing through a cooling air passage (15) formed inside of the blade blows out to the blade surface of the leading edge portion (2) of the cooled blade (1) by way of the air-transpiration holes (4), to thereby shower-head cool the surface of the leading edge portion (2). The air-transpiration holes (4) are formed so as to extend substantially orthogonal to the leading edge surface of the cooled blade (1) such that the acute-angled portions are eliminated, whereby thermal stress is reduced and cracking is prevented.

1 Claim, 3 Drawing Sheets

(a)

GAS TURBINE COOLING BLADE

BACKGROUND OF THE INVENTION

1. Technical Field of the Invention

The present invention relates to a cooled blade of a gas turbine, and in particular to a structure capable of preventing cracks in peripheral portions of air-transpiration holes provided at a leading edge portion of the blade for shower-head cooling thereof.

2. Description of the Related Art

Since the stationary blades and the moving blades of a gas turbine are exposed to a high temperature gas resulting from combustion, it is necessary to cool the interior of the blades. To this end, cooling air passages are provided inside of the blades and cooling air is forced to flow through the cooling air passages to cool the interiors of the blades. FIG. 4 is a perspective view showing a conventional cooled blade of a gas turbine. Referring to the figure, a cooled blade 11 has a leading edge 12 and a trailing edge 13. As can be seen, a number of air-transpiration holes 14 formed in the leading edge portion 12 of the cooled blade 11 blowout the cooling air from the cooling air passage formed inside of the blade to thereby effect so-called shower-head cooling.

FIG. 5(*a*) is a sectional view taken along line C—C in FIG. 4, and FIG. 5(*b*) is a sectional view taken along line D—D in FIG. 4. In these figures, a plurality of air-transpiration holes 14 provided in the leading edge portion 12 of the cooled blade 11 for shower-head cooling are shown in detail. The cooling air flowing through a cooling air passage 15 formed inside of the blade is blown out to the blade surface by way of the air-transpiration holes 14 to shower-head cool the blade surface.

As is shown in FIG. 5(*b*), each of the air-transpiration holes 14 is formed with an inclination relative to the blade surface at the leading edge portion 12. The cooling air blown out of the air-transpiration holes 14 is forced to flow along the blade surface due to such inclination of the air-transpiration holes 14, whereby effective cooling of the blade surface can be achieved.

However, as a result of the oblique disposition of the air-transpiration holes 14 relative to the leading edge 12, acute-angled portions 30 are formed between the blade surface and the air-transpiration holes 14 at inlet/outlet ports thereof. In the blade structure having the acute-angled portions 30 mentioned above, thermal stress taking place around the air-transpiration holes 14 will tend to concentrate at the acute-angled portions 30, creating a problem in that cracks are likely to occur around the air-transpiration holes 14.

OBJECT OF THE INVENTION

In light of the state of the art described above, an object of the present invention, which has been made to solve the problem mentioned above, is to protect the leading edge portion of a cooled blade of a gas turbine against cracks by preventing the generation of high thermal stress around the air-transpiration holes by altering the angular disposition of the air-transpiration holes of the cooled blade of the gas turbine relative to the leading edge thereof such that acute-angled portions are eliminated.

SUMMARY OF THE INVENTION

The present invention proposes the following means to achieve the object described above.

A cooled blade of a gas turbine is provided having a cooling air passage formed inside of the cooled blade through which cooling air is caused to flow for cooling the interior of the blade and a number of air-transpiration holes formed at a leading edge portion thereof so that the above-mentioned leading edge portion of the cooled blade is shower-head cooled by the cooling air blowout from the cooling air passages by way of the air-transpiration holes, characterized in that the air-transpiration holes are disposed, relative to the blade surface at the leading edge portion, so as to reduce concentration of stress around inlet/outlet ports when thermal stress at the inlet/outlet ports of the air-transpiration holes at the leading edge portion of the cooled blade is generated. In particular, the air-transpiration holes are preferably provided substantially orthogonal to the blade surface at the leading edge portion.

In the cooled blade of a gas turbine according to the present invention, the air-transpiration holes are formed so as to substantially orthogonally intersect the blade surface at the leading edge portion thereof. Consequently, in the cooled blade according to the present invention, approximately right-angled portions are formed in the vicinity of the air-transpiration holes and the acute-angled portions are essentially eliminated. Thus, even when thermal stress is generated around the air-transpiration holes, concentration of the stress at the inlet/outlet ports of the air-transpiration holes opened in the leading edge portion of the blade is eliminated. As a result, generation of cracks around the air-transpiration holes due to thermal stress can be avoided.

DESCRIPTION OF THE PREFERRED EMBODIMENT

Figure 1:
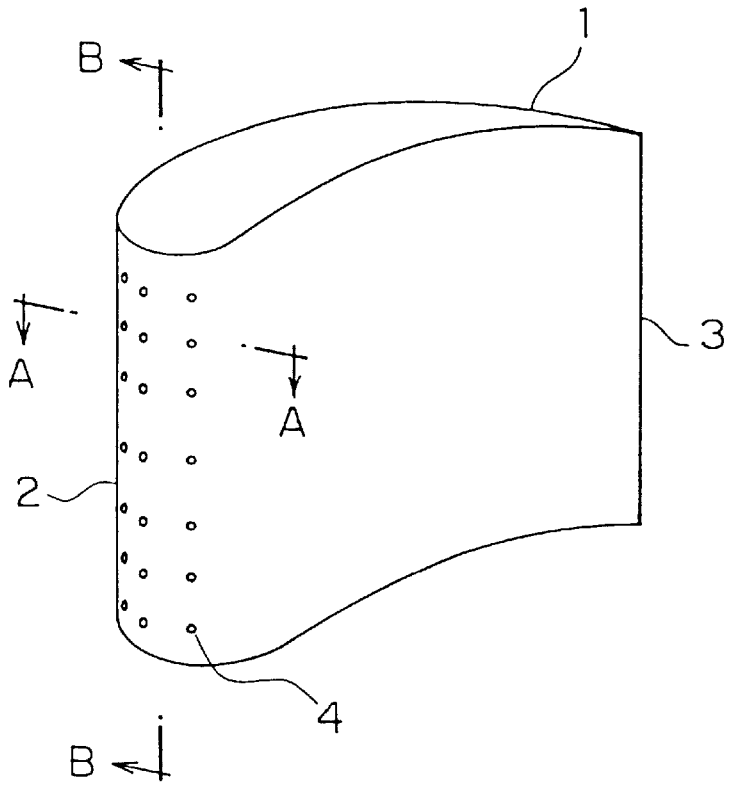
FIG. 1 is a perspective view of a cooled blade of a gas turbine according to an embodiment of the present invention.

The present invention will be described in detail in conjunction with what are presently considered preferred embodiments thereof with reference to the accompanying drawings.

In the following description, like reference numerals designate like or corresponding components throughout the drawings. Also, in the following description it is to be understood that terms such as "right", "left", "top", "bottom" and the like are words of convenience and are not to be construed as limiting terms.

Embodiment 1

Figure 2:
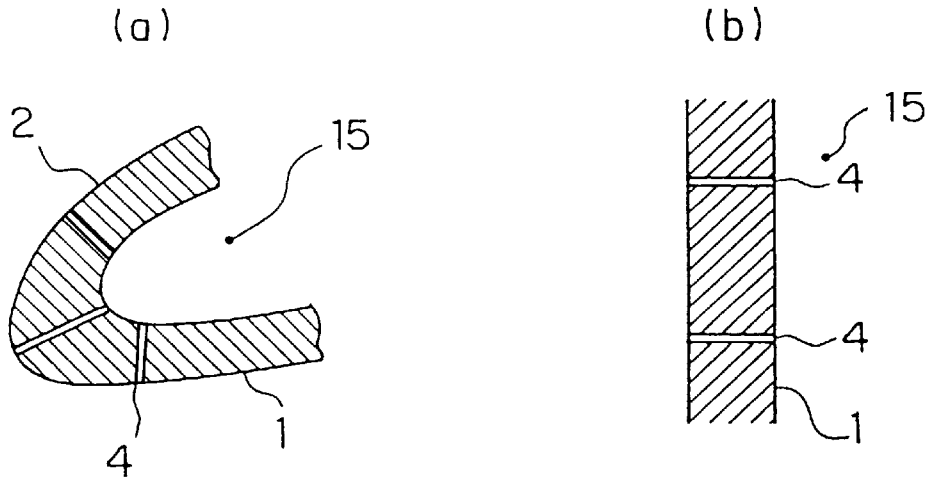
FIGS. 2(*a*) and 2(*b*) are sectional views showing air-transpiration holes in detail, wherein FIG. 2(*a*) is a sectional view taken along line A—A in FIG. 1, and FIG. 2(*b*) is a sectional view taken along line B—B in FIG. 1.

FIG. 1 is a perspective view showing a cooled blade of a gas turbine according to an embodiment of the present invention. FIGS. 2(*a*) and 2(*b*) are sectional views showing air-transpiration holes in detail, wherein FIG. 2(*a*) is a sectional view taken along line A—A in FIG. 1 and FIG. 2(*b*) is a sectional view taken along line B—B. Referring to these figures, a cooled blade 1 has a leading edge portion 2 and a trailing edge 3. The cooled blade 1 has an internally formed cooling air passage 15 through which cooling air is forced to flow to thereby cool the interior of the blade. The leading edge portion 2 is provided with a number of air-transpiration holes 4. The cooling air flowing through the cooling air passage 15 formed inside of the blade is blowout to the blade surface by way of the air-transpiration holes 14, whereby the blade surface of the leading edge portion is shower-head cooled.

As is shown in FIG. 2(*b*), each of the air-transpiration holes 4 is provided so as to extend substantially orthogonal to the blade surface of the leading edge portion 2, and thus the cooled blade is formed with a structure such that the portions which form an acute angle relative to the blade surface at the inlet/outlet ports of the air-transpiration holes are eliminated, whereby generation of stress concentrated around the air-transpiration holes 4 is prevented, and thermal stress is reduced.

Figure 3:
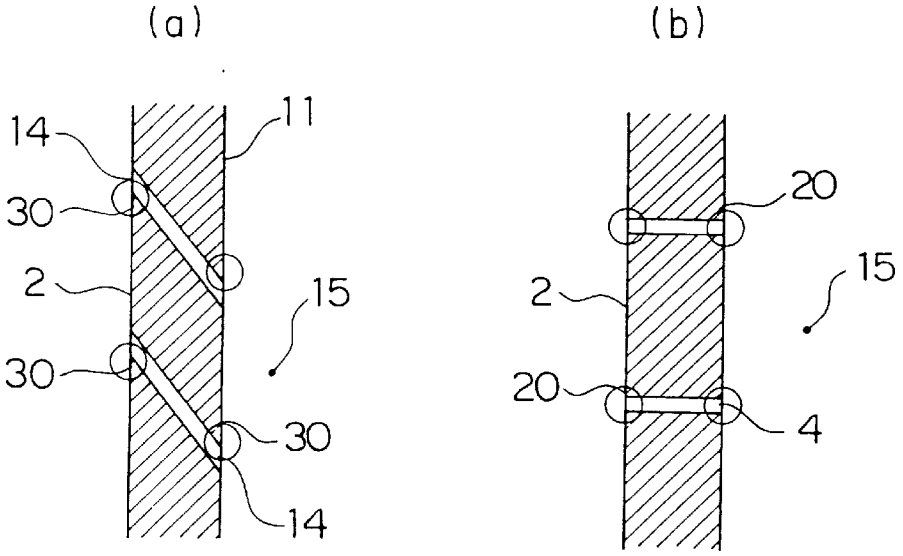
FIGS. 3(*a*) and 3(*b*) are sectional views for comparatively illustrating the air-transpiration holes formed in a cooled blade of a gas turbine according to an embodiment of the present invention and air-transpiration holes of a conventional blade, wherein FIG. 3(*a*) shows the air-transpiration holes of the conventional blade, and FIG. 3(*b*) shows air-transpiration holes formed in the cooled blade according to an embodiment of the invention.
Figure 4:
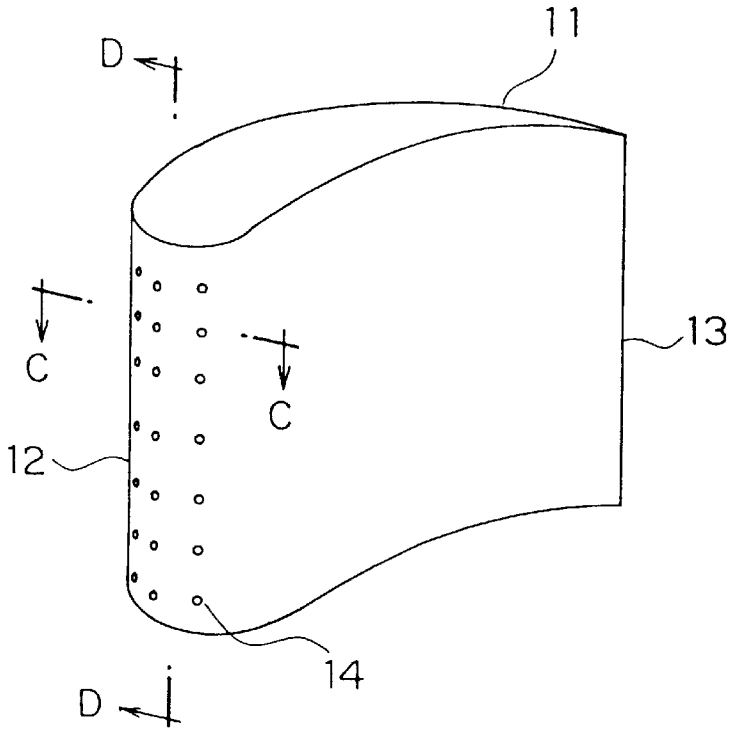
FIG. 4 is a perspective view of a conventional cooled blade of a gas turbine.
Figure 5:
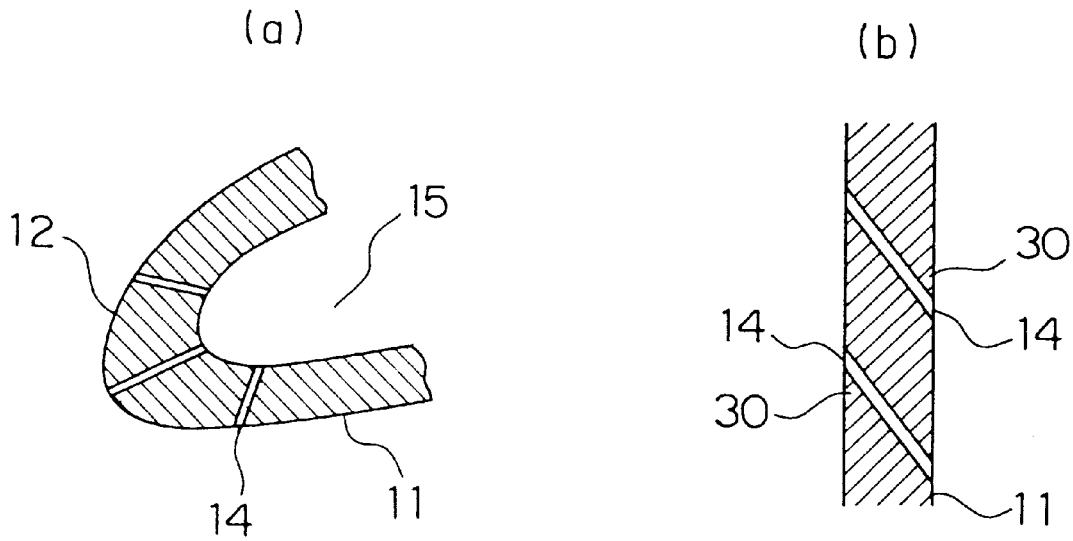
FIGS. 5(*a*) and 5(*b*) are sectional views showing the air-transpiration holes of the conventional cooled blade in detail, wherein FIG. 5(*a*) is a sectional view taken along line C—C in FIG. 4, and FIG. 5(*b*) is a sectional view taken along line D—D in FIG. 4.

FIGS. 3(*a*) and (*b*) show a comparison of the air-transpiration holes 4 according to the present invention and the air-transpiration holes 14 of the conventional blade, wherein FIG. 3(*a*) is a vertical sectional view of a leading edge of a conventional blade and FIG. 3(*b*) is a vertical sectional view of the blade according to the instant embodiment. As can be seen in the figures, in the case of the conventional blade, the air-transpiration holes 14 are obliquely formed relative to the blade surface. As a result, acute-angled portions 30 are formed at the inlet/outlet ports at the leading edge portion 2, as indicated by circles.

In contrast, in the case of the blade according to the instant embodiment shown in FIG. 3(*b*), the air-transpiration holes 4 are formed substantially at right angles relative to the blade surface at the leading edge portion 2, whereby substantially right-angled portions 20, rather than the acute-angled portions of the conventional blade, are formed at the inlet/outlet ports of the air-transpiration holes 4 at the leading edge portion 2, as indicated by circles.

As is apparent from the above description, according to the instant embodiment of the invention, the air-transpiration holes 4 are provided so as to substantially orthogonally intersect the blade surface at the leading edge portion 2 with no acute-angled portions formed around the inlet/outlet ports of the air-transpiration holes 4 at the leading edge portion 2. Instead, since substantially right-angled portions 20 are formed, the thermal stress generated can be remarkably reduced compared to the conventional blade in which the air-transpiration holes 14 are obliquely formed. Hence, cracking around the air-transpiration holes 4 in the leading edge portion 2 can be avoided.

Although it has been described above that air-transpiration holes 4 are provided so as to substantially orthogonally intersect the blade surface, this is only one example. By setting the inclination of the air-transpiration holes to be gentler than the inclination of the air-transpiration holes 14 of the conventional cooled blade, the effect of suppressing the concentration of thermal stress can be enhanced. To this end, the orthogonal or right-angled disposition of the air-transpiration holes is most preferred. Thus, it is safe to say that the angle at which the air-transpiration holes intersect the blade surface at the leading edge portion of the cooled blade can be selectively determined within a range, that generation of cracks can be avoided, between the angle of inclination at which the air-transpiration holes 14 of the conventional blade intersect the blade surface and a right angle while taking into account the effect of the shower-head cooling based on geometrical factors or shapes of the cooled blade and the temperature of the gas resulting from combustion or the pressure of the cooling air and so forth.

Further, it goes without saying that the cooled blade of the gas turbine according to the present invention can find application in both moving blades and stationary blades with essentially the same effect.

In the foregoing embodiment, the mode of carrying out the invention which is considered preferable at present and other alternative modes have been described in detail with reference to the drawings. It should, however, be noted that the present invention is never restricted to these modes but other applications and modifications of the cooled blade of the gas turbine can be easily conceived and realized by those skilled in the art without departing from the spirit and scope of the present invention.

What is claimed is:

1. A cooled blade of a gas turbine, comprising:

a cooling air passage formed inside of the cooled blade through which cooling air is caused to flow for cooling the interior of the cooled blade;

a number of air-transpiration holes formed at a leading edge portion of the cooled blade so that said leading edge portion is shower-head cooled by the cooling air blown out from said cooling air passages by way of said air-transpiration holes; and preventing means operative to reduce concentration of thermal stress around inlet/outlet ports of said air-transpiration holes at said leading edge portion of said cooled blade, thereby preventing cracking of the cooled blade around the inlet/outlet ports, wherein said preventing means comprises said air-transpiration holes, each having an orthogonal orientation in which an axis through said air-transpiration hole is substantially orthogonal to a plane which is tangential to said blade surface at said leading edge portion, none of said air-transpiration holes in said leading edge portion of said cooled blade having an orientation other than said orthogonal orientation.

* * * * *